US009324516B2

(12) United States Patent
Wada et al.

(10) Patent No.: US 9,324,516 B2
(45) Date of Patent: Apr. 26, 2016

(54) CLICK MODULE AND OPERATION SWITCH

(71) Applicants: Kotaro Wada, Aichi (JP); Yasuhide Tanaka, Aichi (JP); Takashi Nose, Aichi (JP); Hidetoshi Yoshikawa, Aichi (JP)

(72) Inventors: Kotaro Wada, Aichi (JP); Yasuhide Tanaka, Aichi (JP); Takashi Nose, Aichi (JP); Hidetoshi Yoshikawa, Aichi (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 0 days.

(21) Appl. No.: 14/478,316

(22) Filed: Sep. 5, 2014

(65) Prior Publication Data

US 2015/0068878 A1 Mar. 12, 2015

(30) Foreign Application Priority Data

Sep. 6, 2013 (JP) ..... 2013-184628

(51) Int. Cl.

| | |
|---|---|
| ***H01H 21/02*** | (2006.01) |
| ***H01H 21/24*** | (2006.01) |
| ***H01H 21/38*** | (2006.01) |
| *H01H 21/22* | (2006.01) |

(52) U.S. Cl.

CPC ..... *H01H 21/02* (2013.01); *H01H 21/24* (2013.01); *H01H 21/38* (2013.01); *H01H 2021/225* (2013.01); *H01H 2215/03* (2013.01); *H01H 2221/08* (2013.01); *H01H 2223/054* (2013.01); *H01H 2231/026* (2013.01); *H01H 2235/01* (2013.01); *H01H 2300/01* (2013.01)

(58) Field of Classification Search

CPC ..... H01H 21/02; H01H 2215/03; H01H 2221/08; H01H 2300/01; H01H 2231/026; H01H 2235/01; H01H 2223/054; H01H 1/18; H01H 1/24

USPC ..... 200/293, 521, 534, 535, 248, 258

See application file for complete search history.

(56) References Cited

U.S. PATENT DOCUMENTS

| | | | | |
|---|---|---|---|---|
| 5,647,478 | A * | 7/1997 | Hirai | H01H 23/02 200/292 |
| 2009/0057120 | A1 * | 3/2009 | Kakuno | H01H 21/24 200/339 |
| 2010/0219055 | A1 * | 9/2010 | Wada | H01H 3/60 200/336 |

FOREIGN PATENT DOCUMENTS

| | | | |
|---|---|---|---|
| JP | 2605918 | Y2 | 9/2000 |
| JP | 2007-087716 | A | 4/2007 |

* cited by examiner

*Primary Examiner* — Edwin A. Leon
(74) *Attorney, Agent, or Firm* — Osha Liang LLP

(57) ABSTRACT

A click module which gives a feeling of click when an operation knob which is tiltably and pivotally supported on a casing of an operation switch is tiltably operated has a click face on which a crest portion or a valley portion is formed, a click element which slides on the click face, and a resilient member which biases the click element to a click face side. The click module is detachably mounted on the casing. The click element and the click face slide relative to each other in an interlocking manner with a tilting operation of the operation knob.

7 Claims, 9 Drawing Sheets

CLICK MODULE AND OPERATION SWITCH

BACKGROUND OF THE INVENTION

1. Field of the Invention

The present invention relates to a click module which gives a feeling of click to a user when an operation knob mounted on a switch is tiltably operated, and an operation switch provided with the click module.

2. Description of the Related Art

For example, in a power window switch used in opening or closing a window of an automobile, a switch element having electric contacts is arranged in the inside of a casing, and an operation knob is tiltably and pivotally supported on the casing. When a user tiltably operates the operation knob, an ON/OFF state of the switch element is changed over. Such an operation switch includes a click mechanism which gives a feeling of click to the user when the user tiltably operates the operation knob.

A click mechanism disclosed in Japanese Utility Model Registration No. 2605918 (patent literature 1) has a click face on which crest portions and valley portions are formed, a click element which slides on the click face, and a resilient member which biases the click element toward a click face side. The click element and the resilient member engage with a sleeve portion formed on the operation knob. The click face is formed on a casing. When the click element slides on the click face in an interlocking manner with the tilting operation of the operation knob, a feeling of click is given to a user.

A click mechanism disclosed in JP-A-2007-87716 (patent literature 2) includes an operation shaft which corresponds to a click element, and a clicking spring member on which a click face is formed. The operation shaft is mounted on a switch element which, is mounted on a board. The operation shaft is slidably movable parallel to the board. The clicking spring member is mounted on the board. When an arm slidably moves the operation shaft so that the operation shaft slides on the click face in an interlocking manner with a tilting operation of an operation knob, a feeling of click is given to a user.

SUMMARY

In the conventional click mechanisms, at least one of the click face, the click element and the resilient member is formed on the casing, is mounted on the board or engages with the operation knob. Accordingly, it is also necessary to assemble the click mechanism simultaneously with the operation switch and hence, the assembling operation is difficult. Further, each time a constitutional part of the operation switch such as the casing, the operation knob or the board is changed, it is necessary to modify the click mechanism such as the click face, the click element, the resilient member, portions around these constitutional parts or the like and hence, the conventional click mechanisms exhibit poor general-use property. Further, when a malfunction occurs as the result of the wear of the click element or the click face, it is also necessary to exchange the casing, the board or the like together with these constitutional parts and hence, the maintainability of the conventional click mechanisms is low.

One or more embodiments of the present invention provides an operation switch which can enhance assembling operability, the general-use property and the maintainability of a click mechanism of an operation switch.

According to one or more embodiments of the present invention, there is provided a click module which gives a feeling of click when an operation knob which is tiltably and pivotally supported on a casing of an operation switch is tiltably operated. The click module includes a click face on which a crest portion and/or a valley portion is formed, a click element which slides on the click face, and a resilient member which biases the click element toward a click face side. The click module is detachably mounted on the casing. The click element and the click face slide relative to each other in an interlocking manner with a tilting operation of the operation knob.

Further, the operation switch according to one or more embodiments of the present invention includes a casing which houses switch elements therein, an operation knob which is tiltably and pivotally supported on the casing, and the click module.

In the above-mentioned constitution, the click mechanism which includes the click face, the click element and the resilient member is formed into a module such that the click mechanism can be detachably mounted on the casing. Accordingly, the click module is assembled and, thereafter, the click module is mounted on the casing. Further, constitutional parts of the operation switch such as the operation knob may be assembled before or after such mounting of the module on the casing. Accordingly, the click module and the operation switch can be easily assembled independently and hence, assembling operability can be enhanced. Further, even when constitutional parts other than the click module are changed, it is possible to use the click module without modification and hence, the general-use property of the click module can be enhanced. Further, even when a malfunction occurs as the result of the wear of the click element or the click face or the like, it is unnecessary to exchange other constitutional parts and it is sufficient to exchange only the click module and hence, maintainability can be enhanced.

According to one or more embodiments of the present invention, the click module may further include: a holding member which is detachably mounted on the casing and in which a hole portion which allows the insertion of the resilient member on a deep side thereof and the insertion of the click element on an opening side thereof is formed; and an inclination member which is mounted on a periphery of the holding member, on which the click face is formed such that the click face faces the hole portion in an opposed manner, and which makes the click face slide relative to the click element by inclining in an interlocking manner with the operation knob.

According to one or more embodiments of the present invention, in the click module, the hole portion may be formed of a through hole which penetrates the holding member parallel to a tilting plane of the operation knob, and a pair of click elements and a pair of click faces may be formed on both opening sides of the hole portion.

According to one or more embodiments of the present invention, in the click module, the click face may be formed of a plurality of inclined portions having different angles, and a plurality of valley portions and a plurality of crest portions positioned on end portions of each of the inclined portions.

According to one or more embodiments of the present invention, it is possible to enhance assembling operability, general-use property and maintenance of the click structure of an operation switch.

DETAILED DESCRIPTION

Hereinafter, embodiments of the present invention are explained by reference to drawings. In the respective drawings, identical or similar parts, or corresponding parts, are given the same symbols. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
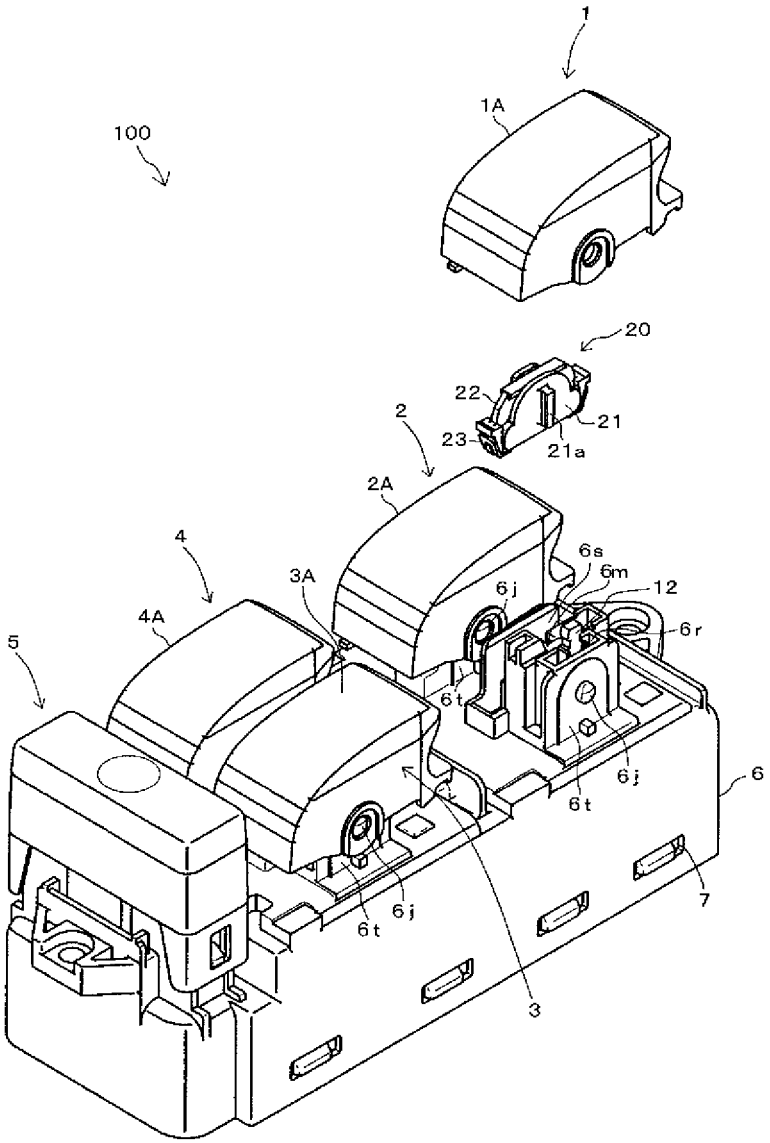
FIG. 1 is a perspective view of a power window switch.

FIG. 1 is a perspective view of a power window switch 100. The power window switch 100 is mounted on an arm rest arranged in the vicinity of a driver's seat for allowing a driver of an automobile to perform an open/close operation of windows for respective seats. The power window switch 100 includes operation switches 1 to 4 for opening/closing windows and an operation switch 5 for locking the windows.

A casing 6 of the power window switch 100 has a rectangular box shape, and a lower side of the casing 6 is closed by a cover 7 (see FIG. 4A or the like described later). The casing 6 and the cover 7 are engaged with each other by fitting engagement by the known locking structure.

As shown in FIG. 1, operation knobs 1A, 2A, 3A, 4A of the respective operation switches 1 to 4 are tiltably and pivotally supported on the casing 6 (the operation knob 1A being shown separately from other operation knobs 2A, 3A, 4A for the sake of convenience of the explanation). To be more specific, the respective operation knobs 1A, 2A, 3A, 4A are mounted on sleeve portions 6*t* by means of shafts 6*j* in a state where the operation knobs 1A, 2A, 3A, 4A cover four sleeve portions 6*t* mounted on the casing 6 respectively (only three sleeve portions 6*t* arranged below the operation knobs 1A, 2A, 3A being shown in FIG. 1). Due to such a constitution, the respective operation knobs 1A, 2A, 3A, 4A are tiltable in the clockwise direction as well as in the counterclockwise direction about the shafts 6*j*.

The operation switch 1 is a switch having an automatic opening/closing function and is used for automatically or manually opening/closing a window of a driver's seat. The operation switch 2 is a switch having no automatic opening/closing function and is used for manually opening/closing a window of a passenger's seat. The operation switches 3, 4 are switches having no automatic opening/closing function and are used for manually opening/closing windows on left and right sides of a rear seat.

In the sleeve portion 6*t* on which the operation knob 1A is mounted, an insertion hole 6*r* into which a lever 12 is inserted, and a mounting portion 6*s* on which a click module 20 is mounted are formed. In the same manner, an insertion portion into which a lever is inserted, and a mounting portion on which a click module is mounted are also formed in other sleeve portions 6*t* (not shown in the drawing).

Hereinafter, the explanation is made by taking the operation switch 1 and the click module 20 for the operation switch 1 as an example.

Figure 2:
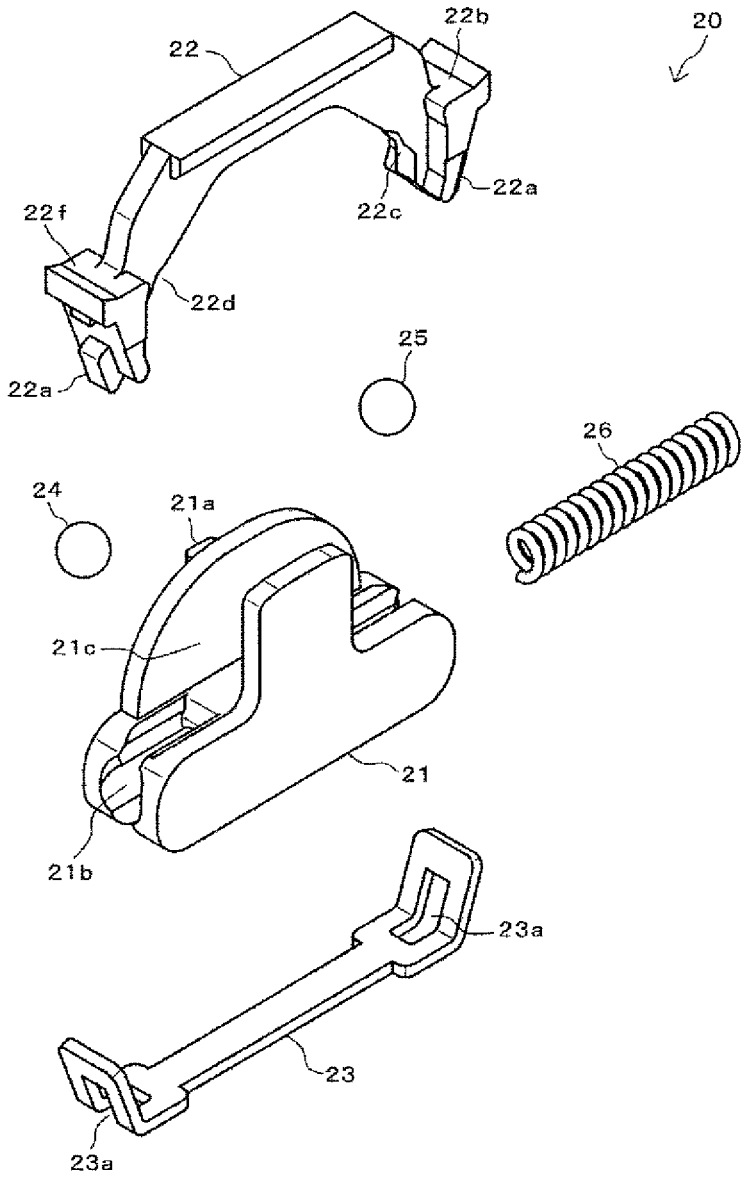
FIG. 2 is an exploded perspective view of a click module according to one or more embodiments of the present invention.
Figure 3A:
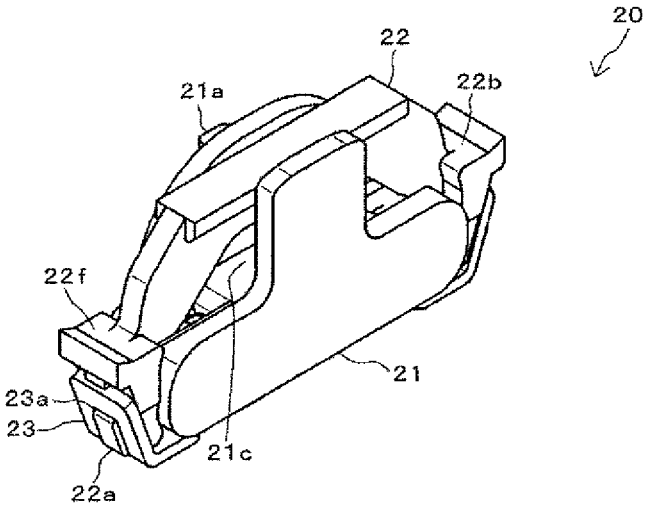
FIG. 3A to FIG. 3C are views showing the click module in an assembled state.
Figure 3B:
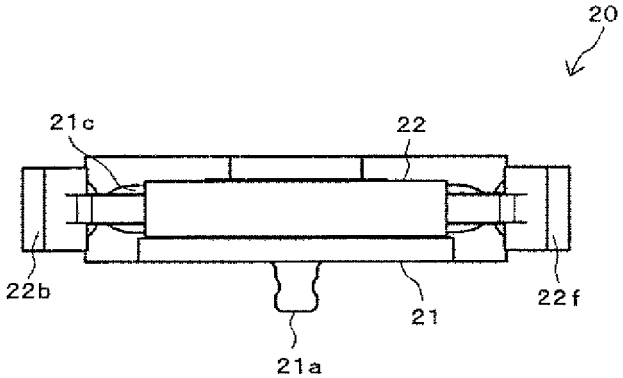
Figure 3C:
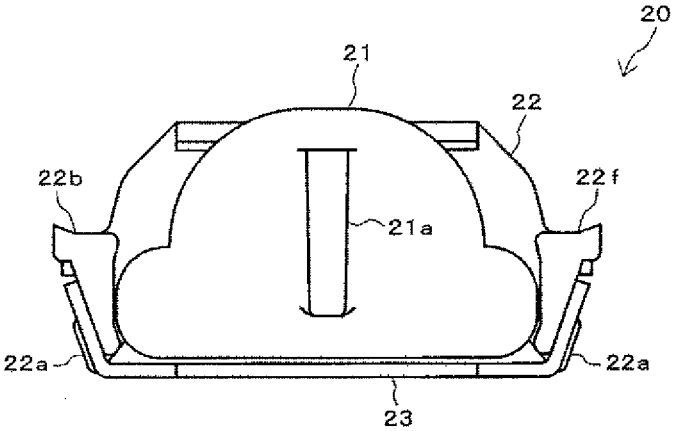

FIG. 2 is an exploded perspective view of the click module 20. FIG. 3A to FIG. 3C are views showing the click module 20 in an assembled state, wherein FIG. 3A is a perspective view of the click module 20, FIG. 3B is a plan view of the click module 20, and FIG. 3C is a front view of the click module 20. FIG. 4A, FIG. 5A, FIG. 6A, FIG. 7A and FIG. 8A are cross-sectional views of the operation switch 1, and FIG. 4B, FIG. 5B, FIG. 6B, FIG. 7B and FIG. 8B are enlarged cross-sectional views of the click module 20. Cross sections shown in FIG. 4A to FIG. 8B are taken parallel to a tilting plane of the operation knob 1A of the operation switch 1. The tilting plane of the operation knob 1A means a plane perpendicular to a center axis of the shaft 6*j* shown in FIG. 1.

Firstly, the structures of the operation switch 1 and the click module 20 are explained.

Figure 4A:
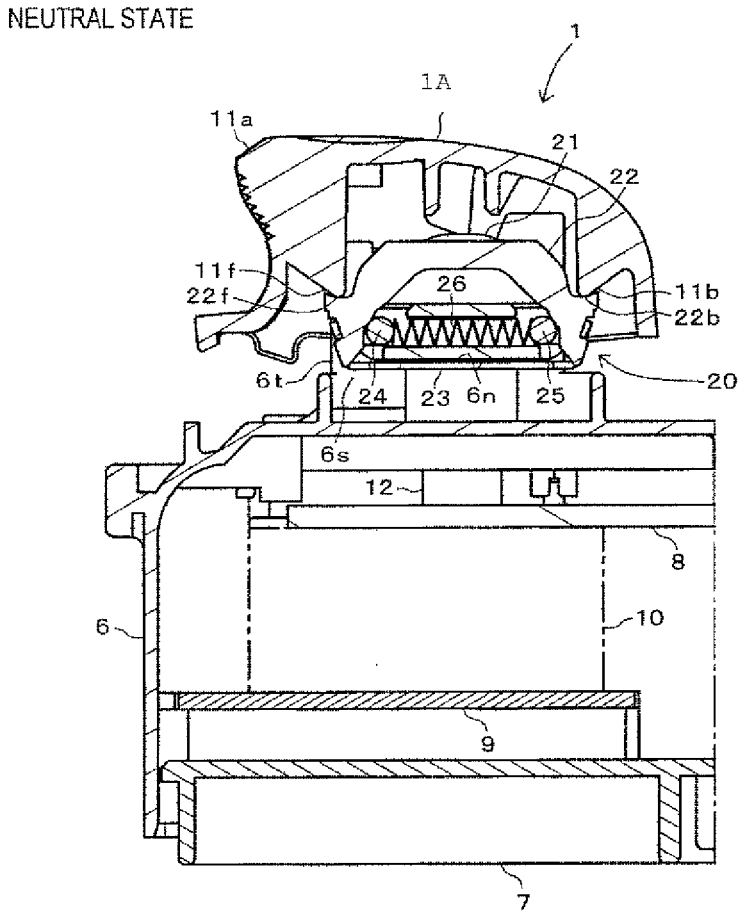
FIG. 4A and FIG. 4B are cross-sectional views of an operation switch and the click module in a neutral state according to one or more embodiments of the present invention.

As shown in FIG. 4A, boards 8, 9 and a switch element 10 are housed in the inside of the casing 6 of the operation switch 1. The boards 8, 9 are respectively formed of a printed circuit board on which electronic parts are mounted and an electric circuit is formed. The switch element 10 includes a plurality of electric contacts and a changeover mechanism which changes over an ON/OFF state of the respective electric contacts (not shown in the drawing). The electric contacts are constituted of a window opening contact, a window closing contact, and an automatic contact, for example. The electric contacts are formed on one board 9 and are electrically connected to the other board 8.

The click module 20 is mounted in the inside of amounting portion 6*s* of the sleeve portion 6*t* of the casing 6. The click module 20 is provided for giving a feeling of click to a user when user tiltably operates the operation knob 1A. As shown in FIG. 2, the click module 20 is constituted of a holding member 21, inclination members 22, 23, click elements 24, 25, and a resilient member 26.

Figure 4B:
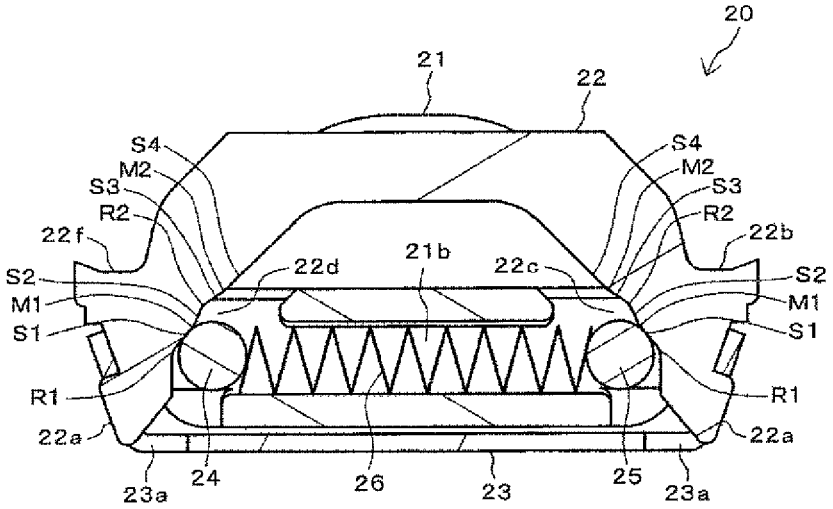

As shown in FIG. 3A to FIG. 3C, a vertically elongated projection 21*a* is formed on a side face of the holding member 21. As shown in FIG. 2, a groove 21*c* is formed on an upper portion of the holding member 21, and a hole portion 21*b* is formed in a lower portion of the holding member 21. As shown in FIG. 4A and FIG. 4B, the hole portion 21*b* is a through hole which penetrates the holding member 21 parallel to a tilting plane of the operation knob 1A. The groove 21*c* extends parallel to the hole portion 21*b*.

As shown in FIG. 2, the inclination members 22, 23 constitute the two-piece structure. The lower inclination member 23 has an approximately concave shape. A rectangular hole 23*a* is formed on both ends of the lower inclination member 23 respectively.

The upper inclination member 22 has an approximately inverse U-shape. A projecting portion 22*a* is formed on both ends of the upper inclination member 22 respectively such that the projecting portions 22*a* project outwardly (see FIG. 2 and FIG. 3C). Depressing portions 22*f*, 22*b* are formed in the vicinity of upper sides of the respective projecting portions 22*a* in a state where the depressing portions 22*f*, 22*b* face upward. Click faces 22*d*, 22*c* are formed on inner sides of both ends of the upper inclination member 22 (see FIG. 2 and FIGS. 4A and 4B).

As shown in FIG. 4B, each click face 22*d*, 22*c* is constituted of a plurality of inclined portions S1 to S4 having different angles, and a plurality of valley portions R1, R2 and a plurality of crest portions M1, M2 positioned on end portions of each of the inclined portions S1 to S4. As shown in FIG. 4A and FIG. 4B, the left and right click faces 22*d*, 22*c* have shapes which are in plane symmetry.

The click elements 24, 25 are formed of a spherical steel ball. That is, the click elements 24, 25 have a convex shape corresponding to click faces 22*d*, 22*c* of the upper inclination member 22 having an approximately concave shape. The resilient member 26 is formed of a compression coil spring.

The click module 20 is assembled as follows. Firstly, the resilient member 26 is inserted into the hole portion 21*b* of the holding member 21, and the click elements 24, 25 are arranged in the vicinity of both openings of the hole portion 21*b* respectively. Then, the upper inclination member 22 is inserted into the groove 21*c* formed on the holding member 21 from above, and the lower inclination member 23 is made to approach the holding member 21 from below and, as shown in FIG. 3, the respective projecting portions 22*a* of the upper inclination member 22 and the respective hole portions 23*a* of the lower inclination member 23 are engaged with each other by fitting engagement.

Due to such steps, the inclination members 22, 23 are mounted around the holding member 21 and become tiltable in the circumferential direction of the holding member 21 (see FIG. 4A to FIG. 8B). As shown in FIG. 4B, the pair of click faces 22*d*, 22*c* of the upper inclination member 22 is arranged so as to face the hole portion 21*b* of the holding member 21. The resilient member 26 is mounted on a deep side of the hole portion 21*b*, and the pair of click elements 24, 25 is mounted on both opening sides of the hole portion 21*b*. The resilient member 26 biases the respective click elements 24, 25 toward the click faces 22*d*, 22*c* to which the click elements 24, 25 face in an opposed manner. Since the click elements 24, 25 respectively engage with the inclined portions S1 of the click faces 22*d*, 22*c* which the click elements 24, 25 face, the click elements 24, 25 and the inclination members 22, 23 are statically held in a stable manner.

The click module 20 which is assembled in the above-mentioned manner is mounted on the mounting portion 6*s* of the sleeve portion 6*t* of the casing 6 shown in FIG. 1. In mounting the click module 20 on the mounting portion 6*s*, the click module 20 is inserted into the mounting portion 6*s* from above while inserting the projecting portion 21*a* of the holding member 21 into a groove 6*m* formed on the mounting portion 6*s*. The groove 6*m* extends in the axial direction of the sleeve portion 6*t*. Due to such a constitution, the projecting portion 21*a* is supported by side walls of the groove 6*m* from both sides and, as shown in FIG. 4A, a lower surface of the holding member 21 is supported on a support face 6*n* formed in the inside of the mounting portion 6*s* from below. Accordingly, the movement of the holding member 21 in the sideward directions and the downward direction and the rotation of the holding member 21 can be prevented.

After the click module 20 is mounted on the mounting portion 6*s*, the operation knob 1A is pivotally supported on the sleeve portion 6*t*. Due to such a constitution, a pair of front and rear projecting portions 11*f*, 11*b* formed on the inner side of the operation knob 1A engages with the pair of depressing portions 22*f*, 22*b* formed on the upper inclination member 22 respectively so that the movement of the holding member 21 in the upward direction can be prevented. That is, the holding member 21 is fixed to the casing 6 in a state where the click module 20 and the operation knob 1A are mounted on the casing 6. The inclination members 22, 23 can be inclined parallel to the tilting plane of the operation knob 1A.

An upper end of the lever 12 shown in FIG. 1 engages with the inner side of the operation knob 1A (not shown in the drawing). Accordingly, the lever 12 forms an integral part of the operation knob 1A and hence, the lever 12 is tiltable together with the operation knob 1A.

The boards 8, 9, the switch element 10 and the like may be housed in the casing 6 and the cover 7 may be mounted on the casing 6 before the click module 20 and the operation knob 1A are mounted on the casing 6 or after the click module 20 and the operation knob 1A are mounted on the casing 6.

In an assembled state shown in FIG. 4, when the operation knob 1A is removed from the sleeve portion 6*t* of the casing 6, the click module 20 can be removed from the mounting portion 6*s* in the upward direction. That is, the click module 20 and the holding member 21 are detachably mounted on the casing 6.

Next, the manner of operation of the operation switch 1 and the click module 20 is explained.

As shown in FIG. 4A, when the operation knob 1A is in a neutral state, the lever 12 assumes a vertical posture. Accordingly, the changeover mechanism of the switch element 10 is held statically in a neutral state so that the respective electric contacts are in an OFF (non-conductive) state. Further, as shown in FIG. 4B, the click elements 24, 25 engage with the inclined portions S1 of the click faces 22*b*, 22*c* respectively. Accordingly, as shown in FIG. 4A and FIG. 4B, an upper surface of the upper inclination member 22 and a lower surface of the lower inclination member 23 become parallel to the axial direction of the hole portion 21*b* and the boards 8, 9 and hence, the horizontal posture of the inclination members 22, 23 is held and the neutral state of the operation knob 1A is also held.

Figure 5A:
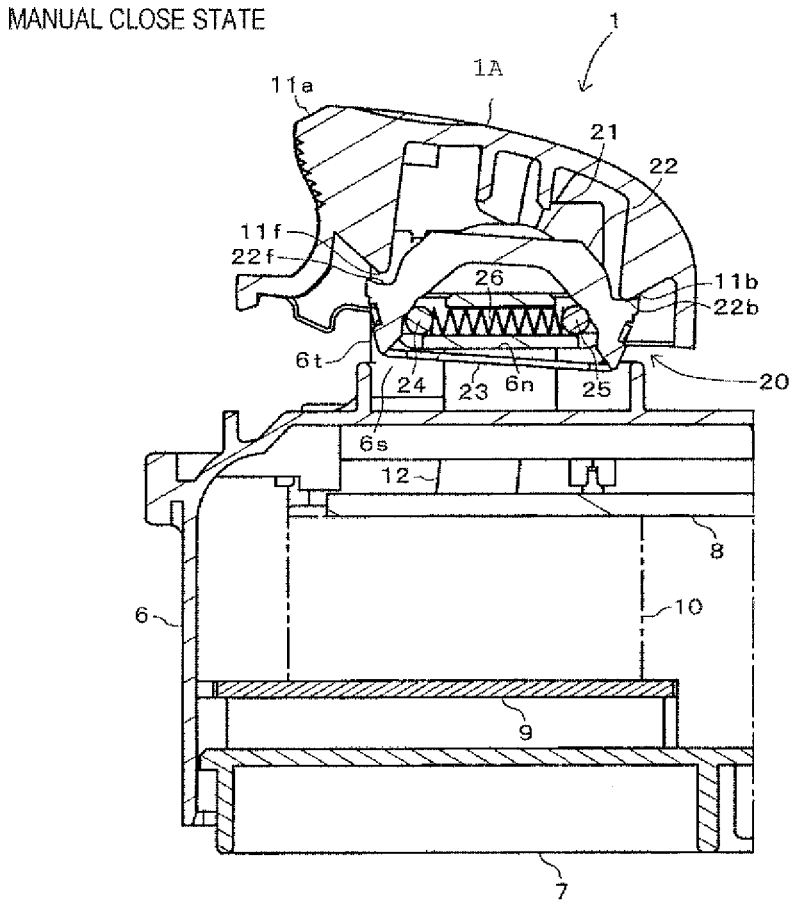
FIG. 5A and FIG. 5B are cross-sectional views of the operation switch and the click module in a state where a manual closing operation is performed.
Figure 5B:
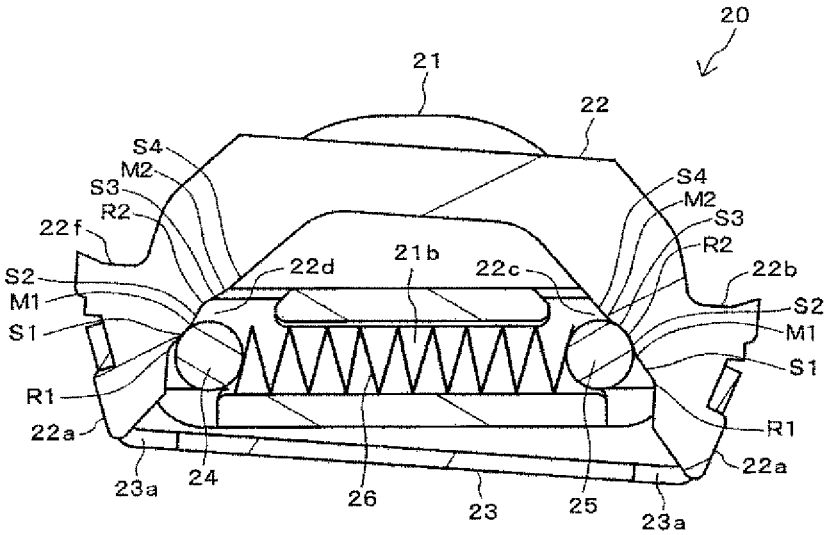

In case of closing the window of the driver's seat, as shown in 5A, the front end portion 11*a* of the operation knob 1A is pulled up so that the operation knob 1A is tiltably operated in the closing direction (clockwise direction in FIG. 5A). As a result, the lever 12 is tilted so that the changeover mechanism of the switch element 10 is operated thus bringing the window closing contact into an ON (conductive) state. Accordingly, the window of the driver's seat is being closed only during a period when the window closing contact is in an ON state (manual close state). On the other hand, the projecting portion 11*b* of the operation knob 1A on a rear side (right side in FIG. 5) pushes down a depressing portion 22*b* of the upper inclination member 22 thus inclining the inclination members 22, 23 toward a rear side. Accordingly, the click face 22*c* of the upper inclination member 22 on a rear side slides relative to the click element 25. That is, the click face 22*c* and the click element 25 slide relative to each other. Then, as shown in FIG. 5B, the click element 25 moves over a first crest portion M1 and assumes a state where the click element 25 engages with inclined portions S2, S3 on both sides of the valley portion R2 so that a first-time feeling of click is given to the user.

Figure 6A:
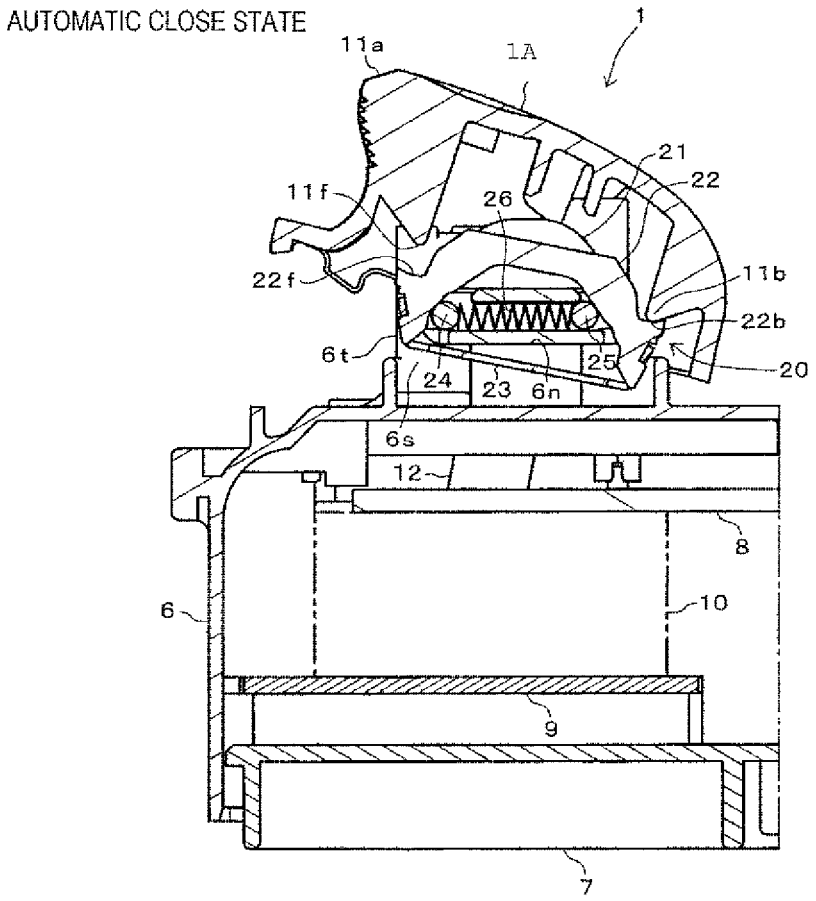
FIG. 6A and FIG. 6B are cross-sectional views of the operation switch and the click module in a state where an automatic closing operation is performed.
Figure 6B:
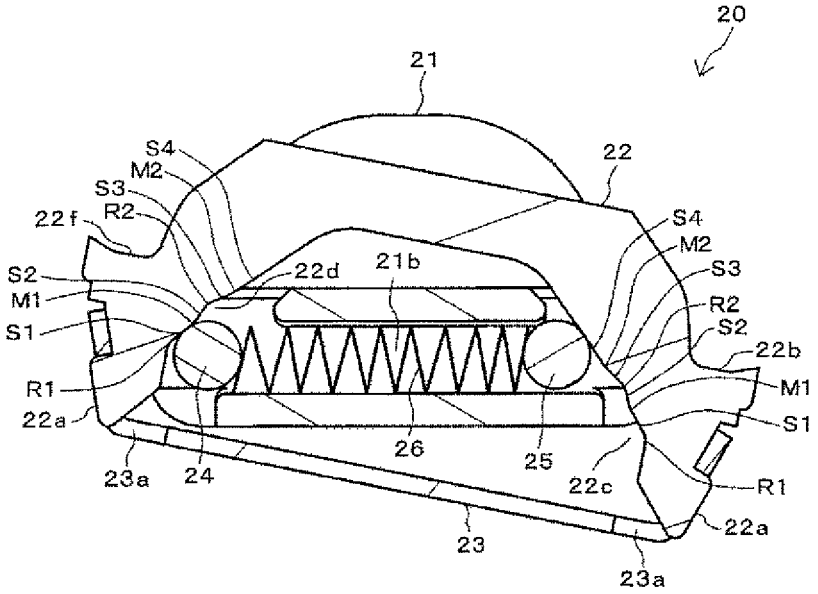

Then, as shown in 6A, the front end portion 11*a* of the operation knob 1A is further pulled up so that the operation knob 1A is further tiltably operated in the closing direction (clockwise direction in FIG. 6A). As a result, the lever 12 is further tilted so that the changeover mechanism of the switch element 10 is operated thus bringing the window closing contact and the automatic contact into an ON state. Accordingly, the window of the driver's seat is closed to a fully-closed position (automatic close state). On the other hand, the projecting portion 11*b* of the operation knob 1A further pushes down the depressing portion 22*b* of the upper inclination member 22 thus further inclining the inclination members 22, 23 toward a rear side. Accordingly, the click face 22*c* and the click element 25 slide further relative to each other and, as shown in FIG. 6B, the click element 25 moves over the second crest portion M2 and assumes a state where the click element 25 engages with the inclined portion S4 so that a second-time feeling of click is given to the user.

Figure 7A:
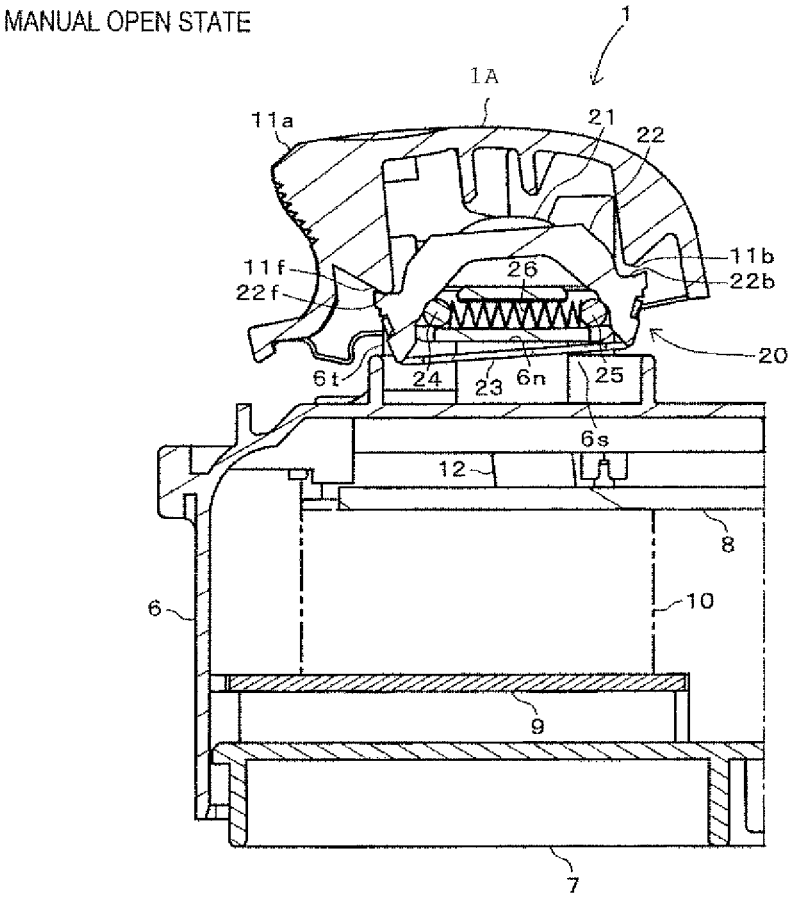
FIG. 7A and FIG. 7B are cross-sectional views of the operation switch and the click module in a state where a manual opening operation is performed.
Figure 7B:
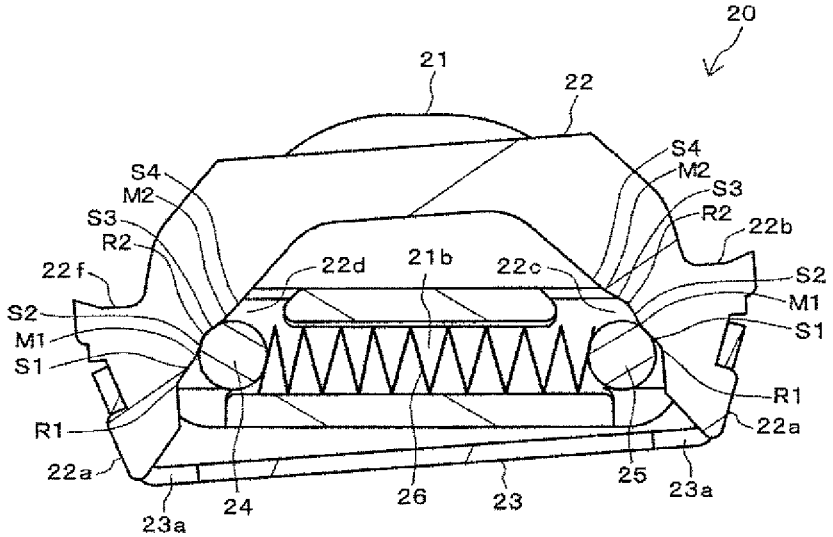

On the other hand, in case of opening the window of the driver's seat, as shown in 7A, the front end portion 11*a* of the operation knob 1A is pushed down so that the operation knob 1A is tiltably operated in the opening direction (counterclockwise direction in FIG. 7A). As a result, the lever 12 is tilted so that the changeover mechanism of the switch element 10 is operated thus bringing the window opening contact into an ON state. Accordingly, the window of the driver's seat is being opened only during a period when the window opening contact is in an ON state (manual open state). On the other hand, the projecting portion 11*f* of the operation knob 1A on a front side (left side in FIG. 7A) pushes down the depressing portion 22*f* of the upper inclination member 22 thus inclining the inclination members 22, 23 toward a front side. Accordingly, the click face 22*d* of the upper inclination member 22 on a front side slides relative to the click element 24. That is, the click face 22*d* and the click element 24 slide relative to each other. Then, as shown in FIG. 7B, the click element 24 moves over the first crest portion M1 and assumes a state where the click element 24 engages with the inclined portions S2, S3 on both sides of the valley portion R2 so that a first-time feeling of click is given to the user.

Figure 8A:
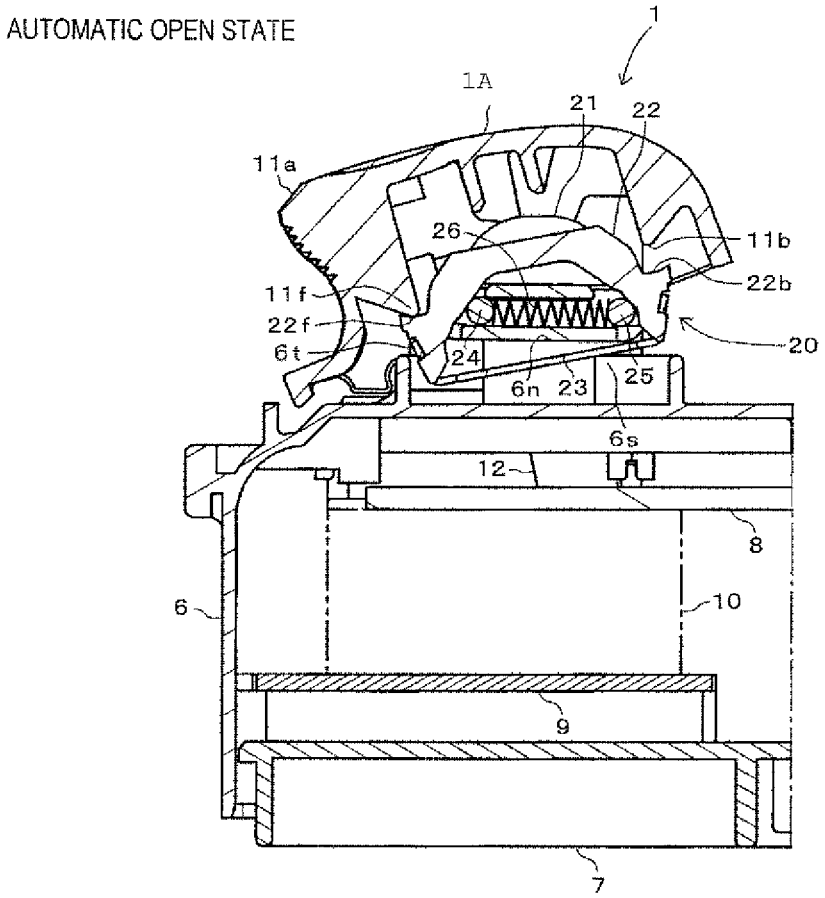
FIG. 8A and FIG. 8B are cross-sectional views of the operation switch and the click module in a state where an automatic opening operation is performed.
Figure 8B:
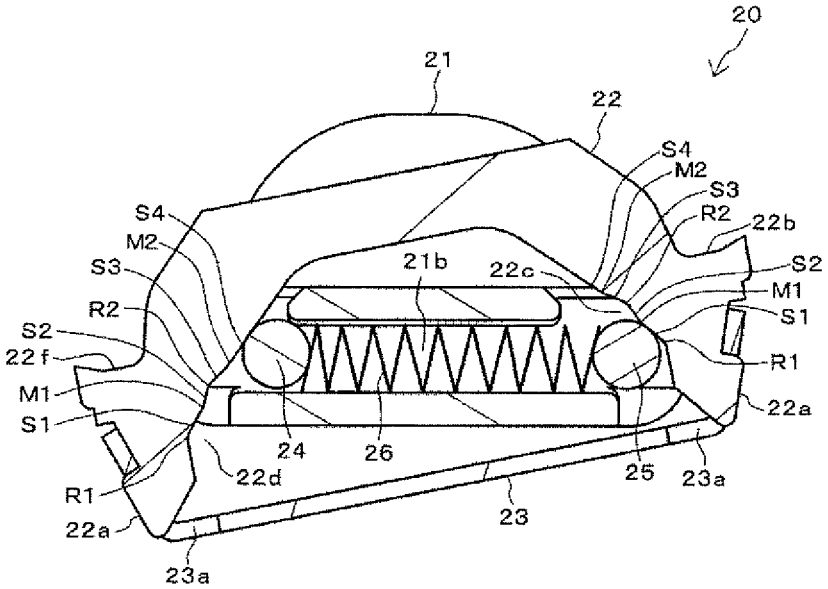

Then, as shown in 8A, the front end portion 11*a* of the operation knob 1A is further pushed down so that the operation knob 1A is further tiltably operated in the opening direction (counterclockwise direction in FIG. 8A). As a result, the lever 12 is further tilted so that the changeover mechanism of the switch element 10 is operated thus bringing the window opening contact and the automatic contact into an ON state. Accordingly, the window of the driver's seat is opened to a fully-opened position (automatic open state). On the other hand, the projecting portion 11*f* of the operation knob 1A further pushes down the depressing portion 22*f* of the upper inclination member 22 thus further inclining the inclination members 22, 23 toward a front side. Accordingly, the click face 22*d* of the upper inclination member 22 on a front side and the click element 24 further slide relative to each other and, as shown in FIG. 8B, the click element 24 moves over the second crest portion M2 and assumes a state where the click element 24 engages with the inclined portion S4 so that a second-time feeling of click is given to the user.

When the operation applied to the operation knob 1A is released, since the click elements 24, 25 are pushed to the click faces 22*d*, 22*c* by a resilient restoring force of the resilient member 26, the click faces 22*d*, 22*c* slide relative to the click elements 24, 25 so as to move the click elements 24, 25 toward a lower side from an upper side of the click faces 22*d*, 22*c*. Accordingly, the inclination members 22, 23 are tilted so as to correct the inclination thereof. Then, the projecting portions 11*f*, 11*b* of the operation knob 1A are pushed up by the depressing portions 22*f*, 22*b* of the upper inclination member 22 so that the operation knob 1A is tilted. Then, as shown in FIG. 4, when the click elements 24, 25 engage with the inclined portions S1 of the click faces 22*b*, 22*c* respectively, the tilting of the inclination members 22, 23 is stopped so that the inclination members 22, 23 are returned to a horizontal posture. Then, the operation knob 1A is returned to the neutral state so that the lever 12 is returned to the vertical posture. Accordingly, the changeover mechanism of the switch element 10 is brought into a neutral state, and the respective electric contacts are brought into an OFF state.

Figure 9:
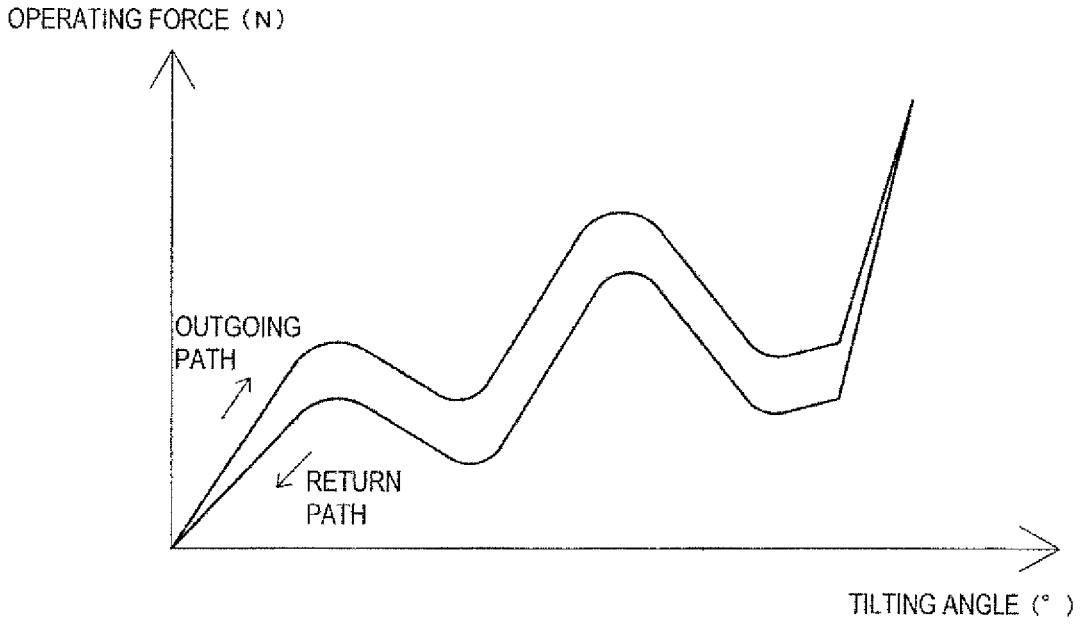
FIG. 9 is a view showing the relationship between an operating force and a tilting angle of an operation knob of the operation switch.

FIG. 9 is a view showing the relationship between an operating force and a tilting angle of the operation knob 1A of the operation switch 1. As described above, when the operation knob 1A is tiltably operated in the opening direction or in the closing direction, the click faces 22*d*, 22*c* and the click elements 24, 25 which correspond to each other in the click module 20 slide relative to each other. In such sliding, as indicated by an outgoing path shown in FIG. 9, the operation force and the tilting angle of the operation knob 1A change. To be more specific, firstly, since the click elements 24, 25 slide on the inclined portion S1 toward the first crest portion M1, as the tilting angle from the neutral position of the operation knob 1A is increased, the operation force is increased. Next, when the click elements 24, 25 move over the first crest portion M1 and reach the inclined portion S2, the operation force is decreased so that a first-time feeling of click is given to the user. Next, when the click elements 24, 25 slide on the inclined portion S3 toward the second crest portion M2 by way of the inclined portion S2, an operating force is increased again. Next, when the click elements 24, 25 move over the second crest portion M2 and reach the inclined portion S4, the operation force is decreased so that a second-time feeling of click is given to the user. Then, as the click elements 24, 25 slide on the inclined portion S4 toward a side opposite to the second crest portion M2, the operating force is increased.

Thereafter, when the operation applied to the operation knob 1A is released, as described above, the operation knob 1A is returned to a neutral state due to a resilient restoring force of the resilient member 26, and the click faces 22*d*, 22*c* and the click elements 24, 25 which correspond to each other slide relative to each other in the opposite directions. In such sliding, as indicated by a return path shown in FIG. 9, as the tilting angle of the operation knob 1A is decreased, the operation force is decreased with a change. That is, feeling of click is given to the user each time the click elements 24, 25 move over the crest portions M2, M1 of the click faces 22*d*, 22*c*.

According to one or more of the above-mentioned embodiments, the click mechanism which includes the click faces 22*d*, 22*c*, the click elements 24, 25 and the resilient member 26 is formed into a module as the click module 20 such that the click mechanism can be detachably mounted in the casing 6 of the power window switch 100. Accordingly, the click module 20 can be mounted on the casing 6 after the click module 20 is assembled. Further, the constitutional parts of the operation switch 1 and the power window switch 100 such as the operation knob 1A, the boards 8, 9 and the switch element 10 can be assembled before or after the click module 20 is mounted in the casing 6. Accordingly, the click module 20, the operation switch 1 and the power window switch 100 can be independently assembled easily and hence, assembling operability can be enhanced.

Further, even when the constitutional part other than the click module 20 (the casing 6, the operation knob 1A, the boards 8, 9, the switch element 10 or the like) is changed, it is possible to use the click module 20 without modification. Accordingly, the general-use property of the click module 20 can be enhanced.

Further, even when a malfunction occurs as the result of the wear of the click elements 24, 25 or the click faces 22*d*, 22*c* or the like, it is unnecessary to exchange other constitutional parts and it is sufficient to exchange only the click module 20 and hence, maintainability can be enhanced. On the other hand, even when a malfunction occurs in the casing 6, the operation knob 1A, the switch element 10, the boards 8, 9 or the like, it is possible to use the click module 20 without an exchange and hence, maintainability can be enhanced also from such a viewpoint.

In one or more of the above-mentioned embodiments, the click module 20 is constituted of the holding member 21, the inclination members 22, 23, the click elements 24, 25, and the resilient member 26. The pair of click faces 22*d*, 22*c* is formed on the inclination members 22, 23, and the pair of click elements 24, 25 and the resilient member 26 are arranged on a holding member 21 side. Due to such a constitution, when the operation knob 1A is tiltably operated in the opening direction or in the closing direction, the inclination members 22, 23 are inclined toward a front side and a rear side, and the click faces 22*d*, 22*c* which correspond to click elements 24, 25 slide relative to the click elements 24, 25 so that a feeling of click can be given to a user.

Particularly, each of the click faces 22*d*, 22*c* is formed of the plurality of inclined portions S1 to S4, the plurality of valley portions R1, R2 and the plurality of crest portions M1, M2. Accordingly, the click elements 24, 25 move over the respective crest portions M1, M2 formed on the click faces 22*d*, 22*c* when the operation knob 1A is tiltably operated so that it is possible to give a feeling of click to the user plural times (twice). Accordingly, operability of a multi-stage (two-stage) operation of the operation knob 1A can be enhanced.

The present invention may adopt various other embodiments besides the above-mentioned embodiments. For example, although the explanation has been made with respect to the case where the click module 20 is applied to the operation switch 1 in one or more of the above-mentioned embodiments, the present invention is not limited to such a case. In addition to the operation switch 1, the click module 20 is also applicable to other operation switches 2 to 4. In such a case, to give a feeling of click to a user only one time respectively when the operation knobs 2A, 3A, 4A of the operation switches 2 to 4 are tiltably operated in the opening direction or in the closing direction, only one crest portion may be formed on the click faces 22*c*, 22*d*, or a tilting angle of the operation knobs 2A, 3A, 4A may be restricted to a small angle, for example.

In one or more of the above-mentioned embodiments, the example where the click module 20 includes two click faces 22*d*, 22*c* and two click elements 24, 25 and one resilient member 26 is given. However, the present invention is not limited to such a structure. Besides such a structure, the click module may include one click face and one click element, or the click module may include a plurality of resilient members, for example. In case where the click module includes one click face and one click element, a crest portion for generating a feeling of click at the time of performing an open operation of the operation knob, and a crest portion for generating a feeling of click at the time of performing a close operation of the operation knob may be formed on the click face.

In one or more of the above-mentioned embodiments, the crest portions and the valley portions are formed on the click faces 22*d*, 22*c*. However, only either one of the crest portions and the valley portions may be formed on the click faces 22*d*, 22*c*.

Above, an example where one or more embodiments of the present invention is applied to the power window switch 100 which includes five operation switches 1 to 5 is given. However, one or more embodiments of the present invention is also applicable to a power window switch which includes six or more operation switches or four or less operation switches. One or more embodiments of the present invention is also applicable to other vehicle-mounted switches. One or more embodiments of the present invention is also applicable to switches for usages other than vehicle-mounted switches.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A click module which gives a feeling of click when an operation knob which is tiltably and pivotally supported on a casing of an operation switch is tiltably operated, the click module comprising:

a click face on which a crest portion or a valley portion is formed;

a click element which slides on the click face; and a resilient member which biases the click element to a click face side, wherein the click module is detachably mounted on the casing, wherein the click element and the click face slide relative to each other in an interlocking manner with a tilting operation of the operation knob, wherein the click module further comprises:

a holding member detachably mounted on the casing, in which a hole portion that allows the insertion of the resilient member on a deep side thereof and the insertion of the click element on an opening side thereof is formed; and an inclination member mounted on a periphery of the holding member, on which the click face is formed such that the click face faces the hole portion in an opposed manner, and wherein the inclination member makes the click face slide relative to the click element by inclining in an interlocking manner with the operation knob.

2. The click module according to claim 1, wherein the hole portion is formed of a through hole which penetrates the holding member parallel to a tilting plane of the operation knob, and wherein a pair of click elements and a pair of click faces are formed on both opening sides of the hole portion.

3. The click module according to claim 1, wherein the click face is formed of a plurality of inclined portions having different angles, and a plurality of valley portions and a plurality of crest portions positioned on end portions of each of the inclined portions.

4. The click module according to claim 2, wherein the click face is formed of a plurality of inclined portions having different angles, and a plurality of valley portions and a plurality of crest portions positioned on end portions of each of the inclined portions.

5. An operation switch comprising:

the click module according to claim 1;

a casing which houses a switch element; and an operation knob tiltably and pivotally supported on the casing.

6. An operation switch comprising:

the click module according to claim 2;

a casing which houses a switch element; and an operation knob tiltably and pivotally supported on the casing.

7. An operation switch comprising:

the click module according to claim 3;

a casing which houses a switch element; and an operation knob tiltably and pivotally supported on the casing.

* * * * *